US011971044B2

(12) United States Patent
Gallinelli et al.

(10) Patent No.: US 11,971,044 B2
(45) Date of Patent: Apr. 30, 2024

(54) COMPRESSION SYSTEM AND METHOD OF CONTROLLING A COMPRESSION SYSTEM

(71) Applicant: NUOVO PIGNONE TECNOLOGIE—S.r.l, Florence (IT)

(72) Inventors: Lorenzo Gallinelli, Florence (IT); Laurence Casali, Florence (IT); Marco Pelella, Florence (IT)

(73) Assignee: Nuovo Pignone Tecnologie—S.r.l., Florence (IT)

( * ) Notice: Subject to any disclaimer, the term of this patent is extended or adjusted under 35 U.S.C. 154(b) by 358 days.

(21) Appl. No.: 17/594,204

(22) PCT Filed: Apr. 7, 2020

(86) PCT No.: PCT/EP2020/025163
§ 371 (c)(1),
(2) Date: Oct. 6, 2021

(87) PCT Pub. No.: WO2020/207627
PCT Pub. Date: Oct. 15, 2020

(65) Prior Publication Data

US 2022/0178379 A1 Jun. 9, 2022

(30) Foreign Application Priority Data

Apr. 10, 2019 (IT) ..... 102019000005554

(51) Int. Cl.
*F04D 27/02* (2006.01)
*F25B 49/02* (2006.01)

(52) U.S. Cl.
CPC ..... *F04D 27/0253* (2013.01); *F04D 27/0207* (2013.01); *F25B 49/022* (2013.01)

(58) Field of Classification Search
CPC .. F04D 27/0253; F04D 27/02; F04D 27/0207; F25B 49/022; F25B 49/02
See application file for complete search history.

(56) References Cited

U.S. PATENT DOCUMENTS 4,077,743 A * 3/1978 Cochrane ..... F04D 27/0207 417/53
4,526,513 A * 7/1985 Bogel ..... F04B 49/02 417/18

(Continued)

FOREIGN PATENT DOCUMENTS

EP 3396169 A1 10/2018
KR 2015 0058805 A 5/2015

OTHER PUBLICATIONS

Zeckendorf, et al., "Design, Simulation Create Low Surge, Low Cost Gas-Injection Compressor," Oil & Gas Journal (Jan. 16, 1995).

*Primary Examiner* — Woody A Lee, Jr.
*Assistant Examiner* — Joshua R Beebe
(74) *Attorney, Agent, or Firm* — Paul Frank + Collins P.C.

(57) ABSTRACT

A compression system comprises a compressor, an inlet duct, a throttling valve installed in the inlet duct, an outlet duct, an anti-surge valve fluidly coupling the outlet duct with a portion of the inlet duct downstream of the throttling valve and a recycle valve fluidly coupling the outlet duct with a portion of the inlet duct upstream of the throttling valve. Keeping the recycle valve open, the anti-surge valve closed and the throttling valve partially closed allows lowering the pressure of the flow entering the compressor during its start-up.

20 Claims, 3 Drawing Sheets

(56) References Cited

U.S. PATENT DOCUMENTS

| | | | | |
|---|---|---|---|---|
| 8,532,830 | B2 * | 9/2013 | Van Dijk | F04D 27/0207<br>700/282 |
| 2010/0272588 | A1 * | 10/2010 | Scotti Del Greco | F02C 1/005<br>417/408 |

* cited by examiner

COMPRESSION SYSTEM AND METHOD OF CONTROLLING A COMPRESSION SYSTEM

TECHNICAL FIELD

The subject-matter disclosed herein relates to gas compression systems for industrial applications and to methods for controlling the compression systems.

BACKGROUND ART

A compression system comprises at least a compressor, for example an centrifugal compressor connected to a rotary actuator, an inlet duct and an outlet duct.

In order to avoid surges, or to keep them under control, a modern compression system often comprises an anti-surge loop connecting the outlet duct with the inlet duct, and a valve which may be opened to establish a flow in the loop between compressor discharge and compressor suction.

During standard operations, a controller measures or calculates the operating point of the compressor and determines whether or not to activate di anti-surge loop. Activation of the anti-surge loop increases the pressure upstream of the compressor and decreases the pressure downstream of the compressor, reducing the pressure ratio and allowing a recover from a surge or to avoid a possible surge.

During the start-up procedure, the system is usually isolated and the anti-surge loop is kept open in order to reduce the pressure ratio on the compressor in order to avoid surges at low flow rates.

The compressor driver or actuator are designed and sized in order to carry out the start-up procedure, and often to complete it in a pre-determined amount of time. For this reason it is desirable to reduce loads on the compressor during start-up.

One of the know methods to reduce to loads during start-up consists in lowering the pressure of the gas (and therefore its density) upstream of the compressor. This can be done by positioning a valve inside the anti-surge loop and throttling it in order to cause a pressure drop upstream of the compressor.

Positioning a valve inside the anti-surge loop is however undesirable as it increases the risk of failure of the anti-surge system due to the possibility of failure of the additional valve, which may result in grave damage to people or things.

Therefore, it would be desirable to lower the upstream pressure without positioning an additional valve inside the anti-surge loop.

SUMMARY

According to one aspect, the subject-matter disclosed herein relates to a compression system having a system inlet and a system outlet, the compression system has: a compressor having a compressor inlet and a compressor outlet; an inlet duct fluidly coupling the compressor inlet with the system inlet, the inlet duct is divided into a first duct portion and a second duct portion, a first end of the first duct portion is fluidly coupled with the system inlet, a first end of the second duct portion is fluidly coupled to the compressor inlet; an outlet duct fluidly coupling the compressor outlet with the system outlet; a throttling valve fluidly coupling a second end of the first duct portion and a second end of the second duct portion; an anti-surge valve fluidly coupling the outlet duct with the second duct portion; and a recycle valve fluidly coupling the outlet duct with the first duct portion; the throttling valve is configurable in an open condition and in at least one partially closed condition.

According to another aspect, the subject-matter disclosed herein relates to a method of controlling a compression system, the method comprises the steps of: B) partially closing a throttling valve which controls an incoming flow to an inlet of a compressor of the compression system; C) turning the compressor on; D) generating a first recycle flow from an outlet of the compressor to the inlet of the compressor, the first recycle flow passes through the throttling valve; E) after a speed of the compressor has reached or exceeded a predetermined value, generating a second recycle flow from the outlet of the compressor to the inlet of the compressor, the second recycle flow bypasses the throttling valve; and F) after the speed has reached or exceeded the predetermined value, stopping the first recycle flow.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS

Figure 1:
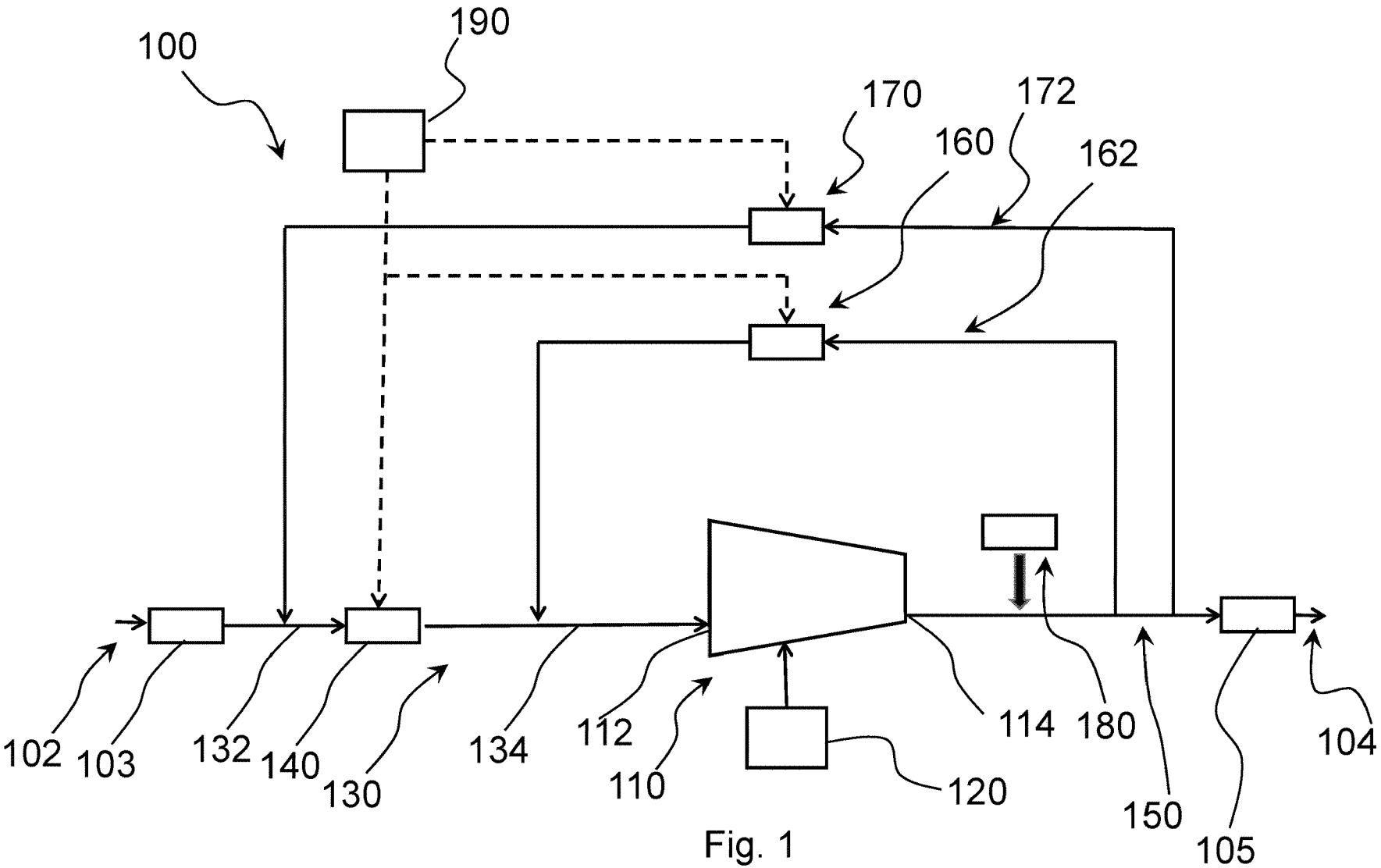
FIG. 1 illustrates a schematic view of an embodiment of a compression system as disclosed herein.

The subject matter herein disclosed relates to a compression system and a method for controlling a compressor system.

During start-up, the outlet of the compressor (also known as "compressor discharge") is put in communication with the inlet of the compressor (also known as "compressor suction") to create a flow loop. In the compression system hereby disclosed, this is accomplished by two return ducts which fluidly connect the outlet with the inlet and can by activated independently by respective valves to establish a return flow from the outlet to the inlet of the compression. One of the return ducts is called "recycle duct" and the valve that activates it is called "recycle valve", the other return duct is called "anti-surge duct" and the valve that activates it is called "anti-surge valve".

During normal operations of the compressor system, the anti-surge duct and the anti-surge valve may be used to establish a return flow which prevents a surge of the compressor. Also, the recycle duct and the recycle valve can be used in case of an emergency shutdown of the compression system to equalize the pressures between the compressor inlet and the compressor outlet.

The inlet duct of the compression system has a throttling valve which regulates the gas flow towards the compressor inlet during normal operations. The recycle duct is fluidly connected to the inlet duct upstream of the throttling valve so that its return flow goes through the throttling valve, whereas the anti-surge duct is fluidly connected to the inlet duct downstream of the throttling valve in order to by-pass it.

In order to reduce the load on the compressor during start-up, the compression system disclosed hereby aims at lowering the flow pressure of the gas at the inlet of the compressor. This is accomplished by starting-up the compressor with the recycle valve open, the anti-surge valve closed and the throttling valve partially closed in order to create a return flow that goes through the recycle duct during the acceleration of the compressor and has a pressure drop at the throttling valve.

After the compressor has accelerated to a desired speed, the compressor system is configured to close the recycle valve and to open and regulate the anti-surge valve in order to by-pass the throttling valve, which is no longer needed to drop the pressure. By-passing the throttling valve reduces the risks of malfunctioning, which can be very dangerous affect the anti-surge system of the compressor.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

When introducing elements of various embodiments the articles "a", "an", "the", and "said" are intended to mean that there are one or more of the elements. The terms "comprising", "including", and "having" are intended to be inclusive and mean that there may be additional elements other than the listed elements.

According to one aspect and with reference to FIG. 1, the subject-matter disclosed herein provides a compression system 100, to be used for example in a plant for treating gasses such as methane, ethane, ethylene, mixed refrigerant, propane, carbon dioxide, azote, helium, argon, air, and hydrogen. The compression system 100 may employed for example in NGL plants, LNG plants, recompression and distribution systems (e.g Sales Gas compression system, High Pressure compression system, Injection compression system to manifold).

The compression system 100 has a system inlet 102 connectable to a gas source and a system outlet 104 connectable to a gas receiving device such as the inlet of a gas storage facility or the inlet of a gas treating plant or the suction of a further compressor train.

The compression system 100 comprises a compressor 110 which has a compressor inlet 112 and a compressor outlet 114. In particular, the compressor 110 is configured to apply a suction at the compressor inlet 112 to receive a flow of gas through the compressor inlet 112, increase the gas flow pressure between the compressor inlet 112 and the compressor outlet 114 and discharge the higher pressure gas flow at the compressor outlet 114. Preferably, the compressor 110 is a centrifugal compressor or an axial compressor.

Preferably, the compression system 100 further comprises a driver 120 connected to the compressor 110 in order to rotationally actuate it. Preferably, the driver 120 comprises a rotary engine, in particular an electric engine. According to a possible alternative embodiment, the driver 120 comprises a turbine positioned in a duct configured to power the compressor 110 by drawing energy from the flow in said duct.

The compression system 100 further comprises an inlet duct 130 extending from the compressor inlet 112 to the system inlet 102 in order to fluidly couple them.

The compression system 100 further comprises a throttling valve 140 positioned in the inlet duct 130 in order to regulate a rate and/or a pressure of a gas flow from the system inlet 102 to the compressor inlet 112. The throttling valve 140 is configurable in an open condition and in one at least partially closed condition. Preferably, the throttling valve 140 is also configurable in a plurality of different intermediate conditions between the open condition and the at least partially closed condition. In a preferred embodiment, the throttling valve 140 can be regulated continuously in each condition between the open condition and the at least partially closed condition. According to a possible embodiment, the throttling valve 140 may be closed completely.

The inlet duct 130 is divided into a first duct portion 132 and a second duct portion 134. The first duct portion 132 extends from a first end which is fluidly coupled with the system inlet 102 to a second end which is fluidly coupled with the throttling valve 140. The second duct portion 134 extends from a first end which is fluidly coupled with the compressor inlet 112 to a second end which is fluidly coupled with the throttling valve 140. According to an operative configuration of the compression system 100, the gas in the inlet duct 130 flows from the first end to the second end of the first duct portion 132, then through the throttling valve 140, then from the second end of the first duct portion 132 to the second end of the second duct portion 134, then from the second end to the first end of the second duct portion 134.

The throttling valve 140 acts on the gas flow between the first duct portion 132 and the second duct portion 134. A partially closed configuration of the throttling valve 140 determines a decrease of the gas flow though the inlet duct 130 and a decrease of pressure between the second end of the first duct portion 132 and the second end of the second duct portion 134.

Preferably, the compression system 100 further comprises a system inlet device 103 positioned at the system inlet 102 and configured to fluidly couple the system inlet 102 with the first end of the first duct portion 132. Preferably, the system inlet device 103 comprises an isolation valve configurable in an open condition in which it allows the establishment of a flow from the outside (or from an upstream device connected to the compression system 100) to the inlet duct 130. According to a possible embodiment the system inlet device 103 comprises a one-way valve configured to prevent an outlet of flow across the system inlet 102. According to another possible embodiment, the system inlet device 103 comprises both an isolation valve and a check valve.

The total size of the second duct portion 134 defines a total flow volume between the throttling valve 140 and the compressor inlet 112. Preferably the total flow volume is less than 100 $m^3$, more preferably less than 40 $m^3$. "Said total flow volume" is to be interpreted as the total volume of the fluid instantly flowing towards the compressor inlet 112 between the throttling valve 140 and the compressor inlet 112 itself. Advantageously, the fact that total flow volume is limited reduces the inertia of the compression system 100 at the start-up of the compressor 110.

The compression system 100 further comprises an outlet duct 150 extending from a first end fluidly coupled with the compressor outlet 114 to a second end fluidly couple with the system outlet 104.

Preferably, the compression system 100 further comprises a system outlet device 105 positioned at the system outlet 104 and configured to fluidly couple the system outlet 104 with second end of the outlet duct 150. According to a possible embodiment, the system outlet device 105 comprises an isolation valve configurable in an open condition in which it allows the establishment of a flow from the outlet duct 150 to the outside (or towards a downstream device connected to the compression system 100). According to a possible embodiment the system outlet device 105 comprises a one-way valve configured to prevent an inlet of flow across the system outlet 104. According to a preferred embodiment, the system outlet device 105 comprises both an isolation valve and a check valve.

In particular, the compression system 100 is arranged so that closing both the system inlet device 103 and the system outlet device 105 isolates the compressor 110 from the outside environment and from the plants and/or devices the compression system 100 is connected with.

The compression system 100 further comprises an anti-surge valve 160 fluidly coupling the outlet duct 150 with the second duct portion 134. In particular, the compression system 100 comprises an anti-surge duct 162 extending from a first end fluidly couple with the outlet duct 150 to a second end fluidly coupled with the second duct portion 134 and the anti-surge valve 160 is installed on the anti-surge duct 162.

The anti-surge valve 160 is configurable at least in an open condition, where the anti-surge valve 160 is at least partially open and preferably completely open and which allows the establishment of an anti-surge flow from the outlet duct 150 to the second duct portion 134, and in a closed condition, which terminates the anti-surge flow. Advantageously, when the compressor 110 is turned on, the anti-surge valve 160 in the open condition allows the establishment of an anti-surge flow of fluid from the compressor outlet 114 to the compressor inlet 112 which bypasses the throttling valve 140. In other words, the anti-surge valve 160 and the anti-surge duct 162 allow the establishment of a first loop which by-passes any other valve and/or chamber of the compression system 100 and fluidly couples the compressor outlet 114 with the compressor inlet 112, allowing to lower the pressure ratio between the two, if needed.

Preferably, the anti-surge valve 160 is further configurable at least in a plurality of different intermediate conditions between the open condition and the closed condition. Advantageously, the intermediate conditions of the anti-surge valve 160 allow different flow conditions between the compressor outlet 114 and the compressor inlet 112 across the anti-surge duct in terms of flow rate and/or pressure. In a preferred embodiment, the anti-surge valve 160 can be regulated continuously in each condition between the open condition and the closed condition.

The compression system 100 further comprises a recycle valve 170. In particular, the compression system 100 comprises a recycle duct 172 and the recycle valve 170 is installed on the recycle duct 172. The recycle duct 172 extends from a first end fluidly couple with the outlet duct 150 to a second end fluidly coupled with the first duct portion 132.

The recycle valve 170 is configurable in an open condition which allows the establishment of a recycle flow between the compressor outlet 114 and the compressor inlet 112 which passes through the throttling valve 140. In other words, the recycle valve 170 and recycle duct 172 allow the establishment of a second loop which, differently from the first loop described above, passes through the throttling valve 140 and the recycle valve 170 itself and bypasses other valves and/or chamber of the compression system 100 in order to fluidly couple the compressor outlet 114 with the compressor inlet 112.

The recycle valve 170 is further configurable in a closed configuration which terminates the recycle flow. According to a preferred embodiment, the recycle valve 170 is further configurable at least in a plurality of different intermediate conditions between the open condition and the closed condition. Advantageously, the intermediate conditions of recycle valve 170 allow a plurality of different flow conditions between the compressor outlet 114 to the throttling valve 140. Preferably, the recycle valve 170 can be regulated continuously in each condition between the open condition and the closed condition. According to an alternative embodiment, the recycle valve 170 may be only configurable in the open condition and in the closed condition, in an "on-off" configuration.

According to a possible embodiment, the first duct portion 132 defines an accumulation volume configured to create a pressurized gas reservoir upstream of the throttling valve 140. In this embodiment, regulating the throttling valve 140 allows to control the release of flow from the accumulation volume towards the compressor inlet 112. Preferably, the accumulation volume has a total size comprises between 1 $m^3$ and 500 $m^3$, more preferably, the total size of the accumulation volume is comprised between 10 $m^3$ and 200 $m^3$. In particular, the accumulation volume is entirely defined upstream of the throttling valve 140.

Preferably, the compression system 100 further comprises a cooler 180 installed on the outlet duct 150 in order to lower the temperature of a flow coming from the compressor outlet 114. In particular, the cooler 180 is installed upflow of the anti-surge duct 162 and the recycle duct 172 in order to lower the temperature of the recycle flow and the anti-surge flow when such flows are present in the compression system 100.

Preferably, the compression system 100 comprises a control unit 190 arranged to control the throttling valve 140 and/or the recycle valve 170 and/or the anti-surge valve 160. In particular, the control unit 190 may control the opening of the throttling valve 140, the opening of the recycle valve 170 and the opening the anti-surge valve 160 based (for example) on the speed of the compressor 110.

The control unit 190 comprises a start-up controller which controls at least the throttling valve 140 and the recycle valve 170 during the start-up of the compressor 110. In a possible embodiment the start-up controller also controls the anti-surge valve 160 during the start-up of the compressor 110. Preferably, the start-up controller is deactivated after the compressor 110 has reached a predetermined speed.

Preferably, the control unit 190 also comprises a throttling controller which controls the throttling valve 140 after the start-up of the compressor 110, replacing the start-up controller.

Preferably, the control unit 190 also comprises an anti-surge controller which controls the anti-surge valve 160 in parallel with the start-up controller and/or after the latter has been shut off in order to prevent a surge a compressor 110. The anti-surge controller is configured to monitor one or more parameters related to the flows towards and/or from the compressor 110 and to keep the anti-surge valve 160 closed if the parameters fall in a given range and to open the anti-surge valve 160 if said parameters fall outside the given range in order to prevent a surge of the compressor 110. According to a possible embodiment, the anti-surge controller controls the anti-surge valve 160 according to the pressure ratio between the compressor outlet 114 and the compressor inlet 112 and/or the flow rate through the compressor.

Preferably, the control unit 190 also comprises an emergency shut-down controller which controls the recycle valve 170 in parallel with the start-up controller and/or after the latter has been shut off. In particular the anti-surge controller completely opens the recycle valve 170 when an emergency condition is triggered, for example the pressure ratio between the compressor outlet 114 and the compressor inlet 112 rising above a predetermined limit.

The control unit 190, in particular the start-up controller, is configured to set and maintain the recycle valve 170 in the open condition and the throttling valve 140 in the partially closed configuration during the start-up of the compressor HO. For the purpose of the present application, the start-up of the compressor 110 is considered as the time interval between the moment the compressor 110 is turned on and the moment it reaches its design operational speed in the case of a fixed speed compressor or its minimum operating speed in the case of a variable speed compressor.

According to a first embodiment, the start-up controller is also configured to maintain the anti-surge valve 160 in the closed configuration during the start-up of compressor 110. According to a second embodiment, the anti-surge controller controls the anti-surge valve 160 during start-up and the compression system 100 is designed so that, in normal start-up conditions, the anti-surge controller maintains the anti-surge valve 160 closed as a consequence of the open condition of the recycle valve 170 and the flow parameters that it determines.

Advantageously, the start-up valves configuration set by the start-up controller allows the establishment of the recycle flow described above between the compressor outlet 114 and the compressor inlet 112, wherein the partially closed configuration of the throttling valve 140 determines a pressure drop of the flow towards the compressor inlet 112 and therefore a drop of the load on the compressor 110 itself.

When the speed of the compressor 110 reaches or exceeds a predetermined value, the control unit 190, in particular the start-up controller, is also configured to open the throttling valve, in particular to open it completely. For example, if the compressor 110 is a fixed speed compressor, the predetermined value could be its design operational speed or a percentage of the design operational speed. If the compressor 110 is a variable speed compressor, the predetermined value could be its minimum operating speed or a percentage of the minimum operating speed. Preferably, the opening of the throttling valve 140 follows a predetermined time ramp.

Figure 3:
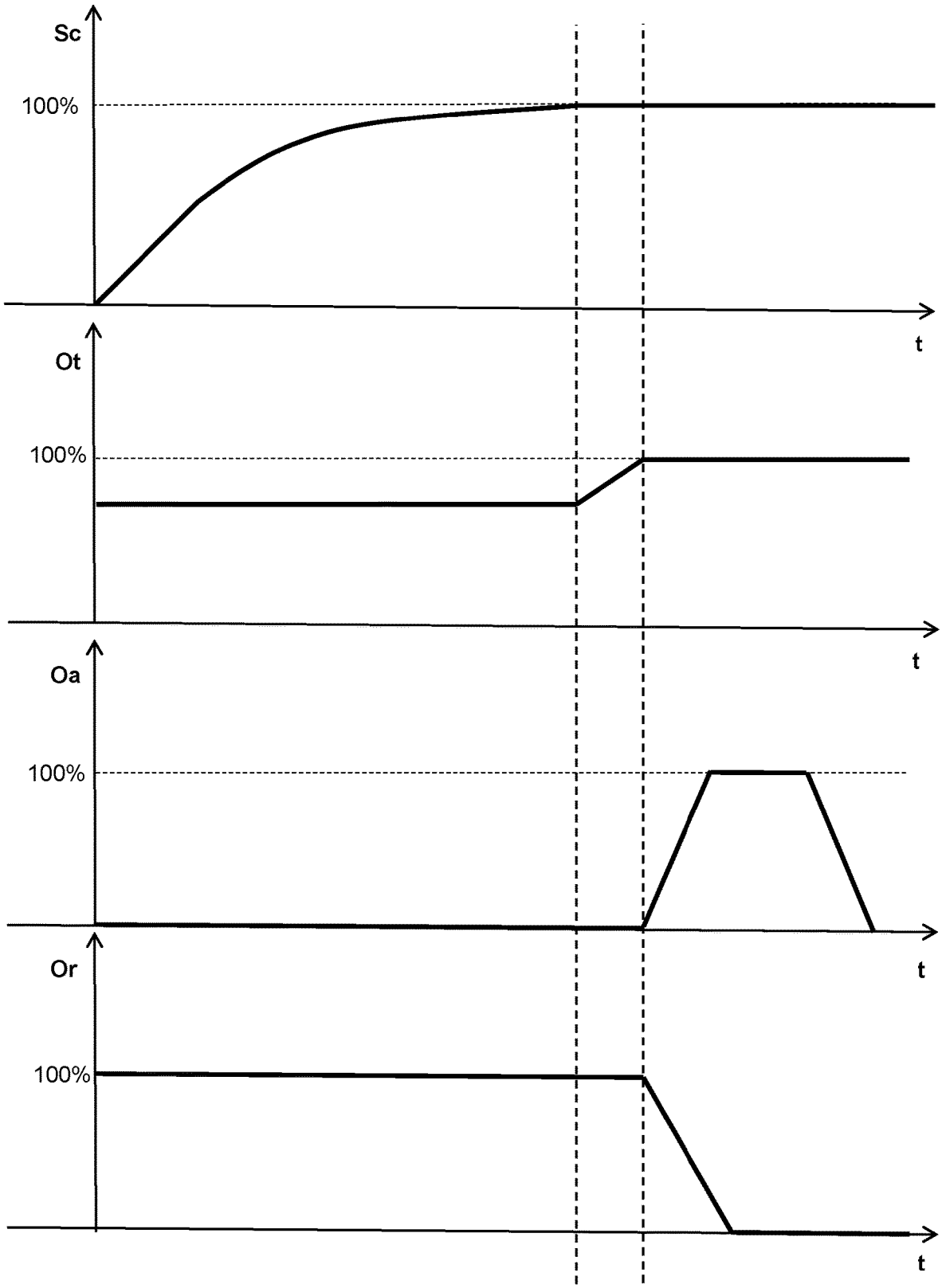
FIG. 3 illustrates time plots of different parameters related to an embodiment of a compression system and a method of controlling a compression system as disclosed herein.

According to the first embodiment, the start-up controller is also configured to open the anti-surge valve 160 and to close the recycle valve 170 when or after the speed of the compressor 110 reaches or exceeds the predetermined value. Preferably, the opening of the anti-surge valve 160 and the closure of the recycle valve 170 are triggered after the throttling valve 140 has completely opened, as shown in FIG. 3. Preferably, the opening of the anti-surge valve 160 and the closure of the recycle valve 170 follow predetermined time ramps.

According to the second embodiment, the start-up controller is configured to close the recycle valve 170, preferably in the same way and at the same time as described above with reference to the first embodiment. In this second embodiment, the anti-surge controller determines an opening of the anti-surge valve 160 as a consequence of the flow conditions determined by the closure of the anti-surge valve 160, which in normal condition lowers the flow rate to the compressor 110 and increases the pressure ratio.

According to a third embodiment, the control unit 190 is configured to manage the recycle valve 170 in order to keep the parameters of the flow to and/or from the compressor 110 in a given range, in particular the pressure ratio and/or the flow rate. In this embodiment, under normal condition, the control unit 190 determines a partial closure of the recycle valve 170 as a consequence of the opening of the throttling valve 140 as the latter determines an increase of the flow rate to the compressor 110 and/or a decrease of the pressure ratio. Preferably, according to the third embodiment, the anti-surge valve 160 is opened by the control unit 190 when the speed of the compressor 110 reaches or exceeds the predetermined value. The recycle valve 170 is automatically closed by the control unit 190 as a consequence of the flow conditions determined by the opening of the anti-surge valve 160, which, in normal circumstances, determine an increase of the flow rate towards the compressor and a decrease of the pressure ratio.

The opening of the throttling valve 140 can be determined by the throttling controller which takes up control of the throttling valve 140 from the start-up controller when the speed of the compressor 110 reaches or exceeds the above-mentioned predetermined value.

In the first and this embodiment, the control unit 190 is configured to activate the anti-surge controller when the speed of the compressor 110 reaches or exceeds a predetermined percentage of the design operational speed (or the minimum operating speed) of the compressor 110, preferably comprised between 50% and 90% and in particular about 70%. The anti-surge controller may be activated when the start-up controller is still active, in this case the anti-surge controller overrides the start-up controller with regards to the anti-surge valve 160 if the flow conditions fall outside of the given range.

Preferably, after the start-up of the compressor 110, the control unit 190 is configured to close the anti-surge valve 160. In particular, the control unit 190 is configured to close the anti-surge valve 160 when both the system inlet device 103 and the system outlet device 105 are set in an open configuration, in order to allow the fluid to flow from the system inlet 102 to the system outlet 104 through the compressor 110. Preferably, the closing of the anti-surge valve 160 is performed automatically by the anti-surge controller after the opening of the system inlet device 103 and the system outlet device 105, which, in normal conditions, lowers the pressure ratio between the compressor outlet 114 and the compressor inlet 112.

Preferably, the control unit 190, in particular the emergency shutdown controller, is configured to open the recycle valve 170 during an emergency shutdown of the compressor 110 in order to equalize (or at least move closer) the pressures of the flow at the compressor inlet 112 and the compressor outlet 114. Advantageously, this configuration allows making use of the same components, namely the recycle valve 170 and the recycle duct 172, for both the start-up and the emergency shut down of the compression system 100, reducing the total number of required components.

FIG. 3 illustrates time plots of the speed "Sc" of the compressor 110, of the opening "Ot" of the throttling valve 140, of the opening "Oa" of the anti-surge valve 160 and of the opening "Or" of the recycle valve 170 according to a possible embodiment in which the openings "Ot", "Oa" and "Or" are managed by the control unit 190, in particular by the start-up controller.

According to a possible alternative embodiment, the recycle valve 170 may be set only partially open, for example 80% open, and the anti-surge valve 160 may be set in a throttled configuration, for example 20% open, before and during the start-up of compressor 110.

Preferably, the compression system 100 further comprises at least one temperature controller connected with the cooler 180 and configured to set the cooler 180 in a start-up configuration during the start-up of the compressor 110 and an operative configuration during the normal operations of the compression system 100 following the start-up.

In the start-up configuration, in particular when the recycle valve 170 and/or the anti-surge valve 160 are open and both the system inlet device 103 and the system outlet device 105 are closed, the temperature controller and cooler 180 are configured to maintain a first temperature of the flow at the compressor output 114 higher than a predetermined value, in particular higher than 100° C., preferably comprised between 120° C. and 500° C., even more preferably comprised between 150° C. and 180°.

In the operative configuration, in particular when the system inlet device 103 and the system outlet device 105 are open, the temperature controller and cooler 180 are configured to maintain a second temperature of the flow at the system outlet 104 lower than the first temperature, and in particular in a range comprised between 0° C. and 100° C., even more preferably comprised between 10° C. and 50° C.

Advantageously, the relatively high value of the first temperature lowers the density of the gas flow through the compressor 110 during the start-up and therefore lowers the load on the compressor 110 while falling within the operational limit of the compressor system 100. The value of the second temperature allows the safe delivery of a flow to the devices connected downstream of the compression system 100, within their operational limits.

Figure 2:
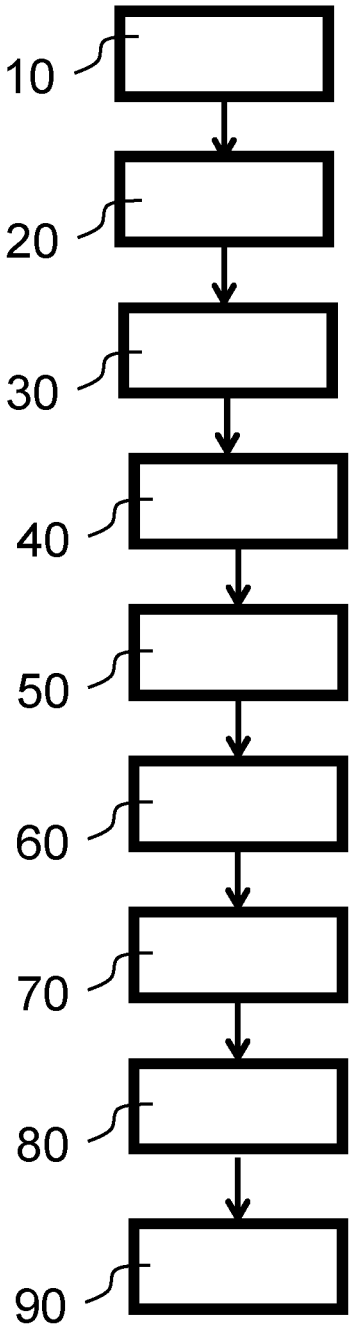
FIG. 2 illustrates a flow-chart of an embodiment of a method of controlling a compression system as disclosed herein.

According to another aspect, the subject-matter disclosed herein provides a method of controlling a compression system, in particular for starting it up. The method is illustrated in FIG. 2. Preferably, the above-mentioned method is applicable to the compression system 100 described above and/or is implemented by the compression system 100.

In a preferred embodiment, the method comprises the preliminary step 10 of closing the system inlet device 103 and the system outlet device 105 in order to seal the system inlet 102 and the system outlet 104.

The method further comprises the step 20 of partially closing the throttling valve 140.

The method comprises the step 30 of turning on the compressor 110. In particular, the step 30 of turning on the compressor 110 leads to a start-up phase in which a speed of the compressor 110 gradually increases from zero to its design operational speed in the case of a fixed speed compressor or to its minimum operating speed in the case of a variable speed compressor.

The compressor turned on generates a gas flow towards the compressor inlet 112 and the partially closed the throttling valve 140 creates a pressure drop in the flow directed to the compressor inlet 112.

Preferably, the step 30 of turning on the compressor 110 comprise set a first temperature of a flow at the outlet 114 of the compressor 110 between 120° C. and 200° C., preferably between 150° C. and 180° C. Preferably, this is accomplished by using the cooler 180 and the temperature controller described above. Preferably, such first temperature at the outlet 114 is maintained until the compressor speed has reached the design operational speed (or the minimum operating speed).

Preferably, after the speed of the compressor has reached the design operational speed (or the minimum operating speed), the method comprises maintaining a second temperature of a flow at the system outlet 104 of the compression system 100 between 0° C. and 100° C., preferably between 20° C. and 50° C. Preferably, this is accomplished by using the cooler 180 and the temperature controller described above.

The method further comprises a step 40 of generating a first recycle flow from the compressor outlet 114 to the compressor inlet 112, wherein the first recycle flow passes through the throttling valve 140. Preferably, the step 40 of generating the a first recycle flow is accomplished by opening the recycle valve 170 and keeping the recycle valve 170 open during the start-up of the compressor 110. In particular, the recycle valve 170 is opened before turning on the compressor 110.

According to a preferred embodiment, the first recycle flow passes through a portion of the outlet duct 150, through the recycle duct 172, through the recycle valve 170, through the throttling valve 140 (which is in the partly closed condition) and through the second duct portion 134. Advantageously, the partly closed condition of the throttling valve 140 determines a pressure drop in the first recycle flow and lowers the load on the compressor 110.

Preferably, after the speed has reached or exceeded a predetermined value, i.e. the design operational speed or the minimum operating speed of the compressor 110 or a percentage of those, the method further comprises the step 50 of completely opening the throttling valve 140.

After the speed of the compressor HO has reached or exceeded the predetermined value, and in particular after the complete opening of the throttling valve 140, the method comprises a step 60 of generating a second recycle flow from the compressor outlet 114 to the compressor inlet 112, wherein the second recycle flow bypasses the throttling valve 140. Preferably, the step 60 of generating the second recycle flow is accomplished by opening the anti-surge valve 160.

More in detail, the second recycle flow passes through a portion of the outlet duct 150, through the anti-surge duct 162, through the anti-surge valve 160, and through a part of the second duct portion 134.

Advantageously, the second recycle flow bypasses all of the valves of the compression system 100 except for the anti-surge valve 160, thus lowering the risk of failures.

A after the speed has reached or exceeded the predetermined value, and in particular after the complete opening of the throttling valve 140, the method comprises a step 70 of stopping the first recycle flow, preferably to be performed at the same time or slightly after as the step 60 of generating the second recycle flow. In particular the step 70 of stopping the first recycle flow comprises closing the recycle valve 170.

Preferably, the steps 60 and 70 of generating the second recycle flow and stopping the first recycle flow comprises gradually closing the recycle valve 170 while, at the same time (or slightly afterwards), gradually opening the anti-surge valve 160. According to the plots of FIG. 3, the recycle valve 170 and anti-surge valve 160 and respectively closed and opened following the same (opposite) time laws.

Preferably, the method further comprises a step 80 of opening the system inlet device 103 and the system outlet device 105 and a step 90 of stopping the second recycle flow. The step 90 of stopping the second recycle flow follows or is performed at the same time of the step 80 of opening the system inlet device 103 and the system outlet device 105. This allows the compression system 100 to receive a flow of fluid from the system inlet 102 and to output a flow of fluid from the system outlet 104 having a higher pressure than the received flow.

Preferably, the method further comprises a step of re-establishing the above-mentioned first recycle flow during an emergency shutdown of the compressor 110, in particular by re-opening the recycle valve 170.

Preferably, the method further comprises a step of re-establishing the second the recycle flow during a surge of the compressor 110, in particular by re-opening the anti-surge valve 160.

The invention claimed is:

1. A compression system having a system inlet and a system outlet, the compression system comprising:

a compressor having a compressor inlet and a compressor outlet;

an inlet duct fluidly coupling the compressor inlet with the system inlet, the inlet duct comprising a first duct portion and a second duct portion, each having a first end and a second end, the first end of the first duct portion fluidly coupled with the system inlet and the first end of the second duct portion fluidly coupled to the compressor inlet;

an outlet duct fluidly coupling the compressor outlet with the system outlet;

a throttling valve fluidly coupling a second end of the first duct portion and a second end of the second duct portion;

an anti-surge valve fluidly coupling the outlet duct with the second duct portion;

a recycle valve fluidly coupling the outlet duct with the first duct portion; and a control unit arranged to control the throttling valve, the recycle valve, and the anti-surge valve, wherein the throttling valve is configurable in an open condition and in at least one partially closed condition, and wherein the control unit is configured to maintain the anti-surge valve in a closed condition and the recycle valve in an open condition during a start-up of the compressor.

2. The compression system of claim 1, wherein the anti-surge valve is configurable in an open condition and in a closed condition or in an open condition, in a closed condition, and in a plurality of different intermediate conditions between the open condition and the closed condition.

3. The compression system of claim 1, wherein the recycle valve is configurable in an open condition and in a closed condition or in an open condition, in a closed condition, and in a plurality of different intermediate conditions between the open condition and the closed condition.

4. The compression system of claim 1, further comprising:

a system inlet device fluidly coupling the system inlet with the first end of the first duct portion.

5. The compression system of claim 1, further comprising:

a system outlet device fluidly coupling the system outlet with the second end of the outlet duct, wherein the outlet duct has a first end and a second end, the first end fluidly coupled with the compressor outlet.

6. The compression system of claim 1, further comprising:

a cooler fluidly coupled to the compressor outlet and arranged to cool a fluid flow from the compressor outlet and provide the fluid to at least one of the anti-surge valve, the recycle valve, or the system outlet.

7. The compression system of claim 6, further comprising:

a temperature controller coupled with and acting on the cooler, the cooler and the temperature controller being arranged to maintain a first temperature of a gas flow at the compressor outlet within a first temperature range between 120° C. and 200° C. during the start-up of the compressor and to maintain a second temperature of a gas flow at the system outlet within a second temperature range between 0° C. and 100° C. after the start-up of the compressor.

8. The compression system of claim 1, wherein the second duct portion defines a total flow volume between the throttling valve and the compressor inlet, and wherein the total flow volume is less than 100 $m^3$.

9. The compression system of claim 1, further comprising:

a recycle duct having a first end fluidly coupled with the outlet duct and a second end fluidly coupled with the first duct portion, wherein the recycle valve is installed on the recycle duct, and wherein the first duct portion of the inlet duct defines an accumulation volume between 1 $m^3$ and 500 $m^3$.

10. The compression system of claim 1, further comprising:

a driver arranged to cause rotation of the compressor at start-up of the compression system.

11. The compression system of claim 1, wherein the control unit is configured to open the anti-surge valve and to close the recycle valve when a speed of the compressor reaches or exceeds a predetermined value.

12. The compression system of claim 11, wherein the control unit is configured to close the anti-surge valve after the start-up of the compressor, and to at least partially open the anti-surge valve to prevent or react to a surge of the compressor.

13. The compression system of claim 1, wherein the control unit is configured to open the recycle valve during an emergency shutdown of the compression system.

14. The compression system of claim 1, wherein the control unit is configured to maintain the throttling valve in a partially closed configuration during the start-up of the compressor and to open the throttling valve when a speed of the compressor reaches or exceeds a predetermined value.

15. The compression system of claim 1, further comprising:

an isolation valve fluidly coupling the system inlet with the first end of the first duct portion.

16. The compression system of claim 1, further comprising:

a one-way valve fluidly coupling the system inlet with the first end of the first duct portion.

17. The compression system of claim 1, further comprising:

an isolation valve fluidly coupling the system outlet with the second end of the outlet duct, wherein the first end of the outlet duct is fluidly coupled with the compressor outlet.

18. The compression system of claim 1, further comprising:

a one-way valve fluidly coupling the system outlet with the second end of the outlet duct, wherein the first end of the outlet duct is fluidly coupled with the compressor outlet.

19. The compression system of claim 1, wherein the system inlet receives gas from a gas storage facility.

20. The compression system of claim 1, wherein the system inlet receives gas from a gas treating plant facility.

* * * * *